US005806119A

United States Patent [19]

Wood

[11] Patent Number: 5,806,119

[45] Date of Patent: Sep. 15, 1998

[54] TOOL HOLDER

[76] Inventor: Robin S. Wood, 2672 Waverly Ave., Camarillo, Calif. 93010

[21] Appl. No.: 818,435

[22] Filed: Mar. 17, 1997

[51] Int. Cl.[6] ..... B26B 11/00

[52] U.S. Cl. ..... 7/118; 81/177.6; 81/440; 30/155; 30/161

[58] Field of Search ..... 30/151, 155, 160, 30/161; 7/118, 138, 155; 81/3.36, 3.47, 3.48, 177.5, 177.6, 440, 490

[56] References Cited

U.S. PATENT DOCUMENTS

| | | | |
|---|---|---|---|
| 778,945 | 1/1905 | Bishop | 81/490 |
| 2,503,380 | 4/1950 | Derby | 7/118 X |
| 4,478,532 | 10/1984 | Puro | 30/155 X |
| 5,101,696 | 4/1992 | Neff | 81/440 X |
| 5,437,101 | 8/1995 | Collins | 30/161 X |

*Primary Examiner*—James G. Smith
*Attorney, Agent, or Firm*—Jack C. Munro

[57] ABSTRACT

A tool holder for golfers that includes a movable housing pivotally and slidably movable relative to a fixed housing. The movable housing is locatable in a closed position encasing a plurality of instruments that are designed to be used by an exterior structure. The movable housing is also to be locatable in an open position and lockable in this position permitting the tool holder to be used as a torque applying tool. The tool holder also includes a plurality of additional instruments any one of which can be located in an outwardly extending position relative to the fixed housing with the movable housing then positionable in the closed position which will fix in position the protruding instrument.

5 Claims, 2 Drawing Sheets

FIG. 5
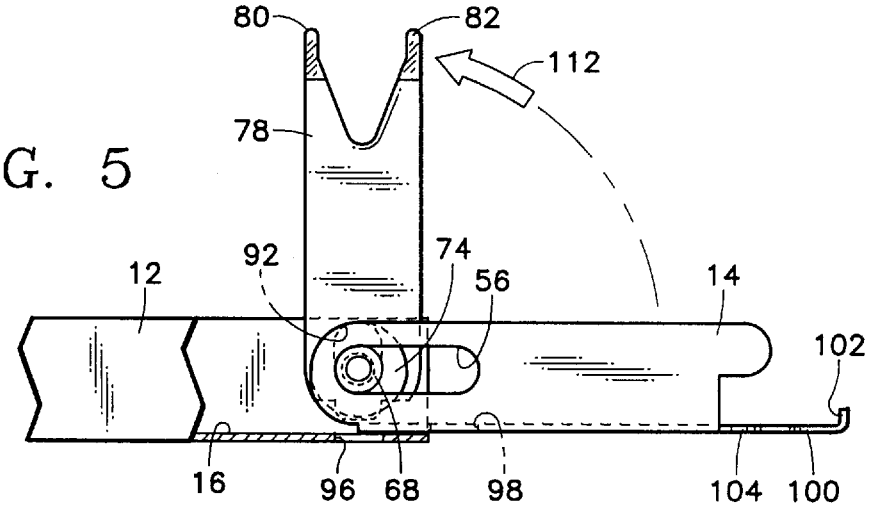
FIG. 6
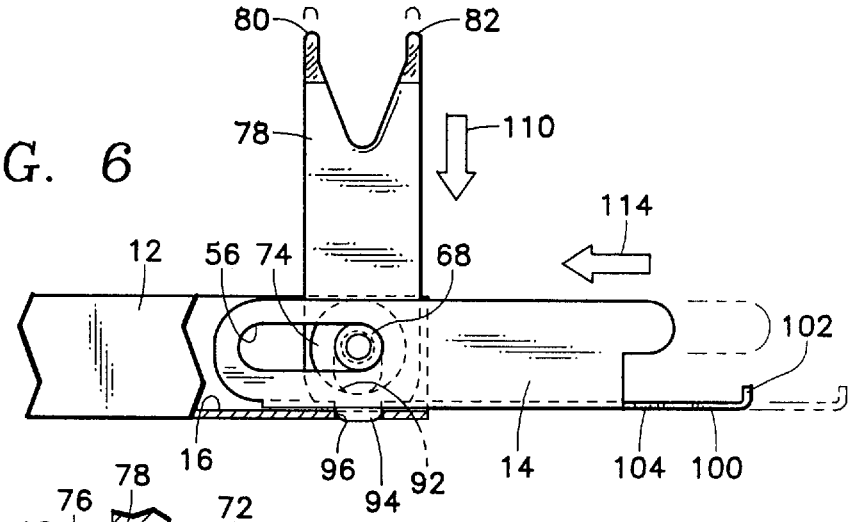
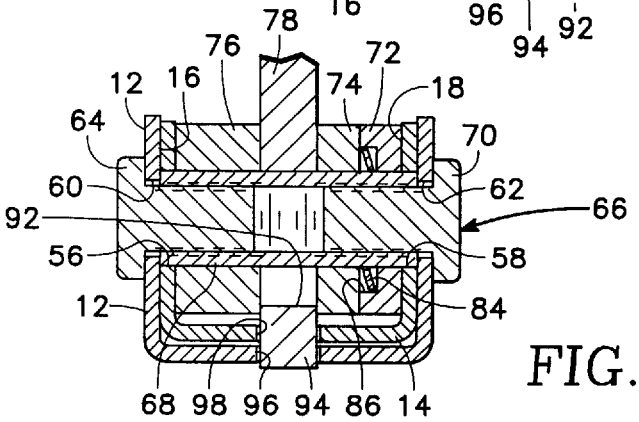
FIG. 7

TOOL HOLDER

BACKGROUND OF THE INVENTION

1) Field of the Invention

The field of this invention relates to tools, and more particularly to a tool holder that includes a plurality of tool instruments.

2) Description of the Prior Art

Holders for tools have long been known. There are a tremendous number of tools that are designed for different fields of usage. By way of example, one field of use is by golfers.

Golfers always use tools when playing the game of golf. There is a tool for tightening of one's spikes. There is a tool for cleaning the grooves of the clubs. There is a tool for fixing ball marks on a green. Also, conventional tools such as can openers and knives are also commonly carried by golfers.

In the past, it was common for a golfer to carry on his or her person a ball mark fixer, a cleat tightening tool, as well as a separate tool for cleaning the grooves on one's clubs. A can opener and a knife blade may not actually be carried on the golfers person but may be located within the golfers golf bag.

In the past, there have been attempts at designing tool holders that would incorporate at least a couple of the tools that are commonly used by golfers. For example, the ball mark fixer may include a tool for cleaning the grooves of the golf clubs. Also, it has been known to design a tool that combines a cleat tightener in conjunction with a ball mark repairing tool. However, prior to the present invention, it has not been known to design a tool holder which incorporated all of the tools that are known to be used by a golfer.

SUMMARY OF THE INVENTION

The structure of the present invention comprises a tool holder which includes a fixed housing and a movable housing. The movable housing is pivotally mounted relative to the fixed housing with the movable housing being movable from a closed position in conjunction with the fixed housing to an open position. When in a closed position, all the instruments of the tool holder are encased. When in an open position, any one of the instruments is capable of being placed in a usage position. A torque applying tool, such as the tool that is to be used to tighten the cleats of golf shoes, is to be lockingly positioned in conjunction with the movable housing and the fixed housing when the movable housing is in the open position. This will permit the movable housing and fixed housing, which are now aligned, to be used as a handle in conjunction with the torque applying tool. Other instruments are also mounted in conjunction with the fixed housing with any one of these other instruments to be located in an outwardly extending position and is capable of being locked in that position by moving of the movable housing to the closed position.

The primary objective of the present invention is to construct a tool holder which includes every known type of instrument that is commonly used by golfers.

Another objective of the present invention is to construct a tool holder that conveniently packages the instruments into a single unit that are commonly used by golfers while playing a round of golf.

BRIEF DESCRIPTION OF THE DRAWINGS

FIG. 5 is a cutaway cross-sectional view showing the torque applying instrument of this tool holder in an unlocked position taken along line 5—5 of FIG. 2;

FIG. 6 is a view similar to FIG. 5 but showing the torque applying tool in the locked position;

FIG. 7 is a cross-sectional view taken along line 7—7 of FIG. 2.

DETAILED DESCRIPTION OF THE PREFERRED EMBODIMENT

Figure 1:
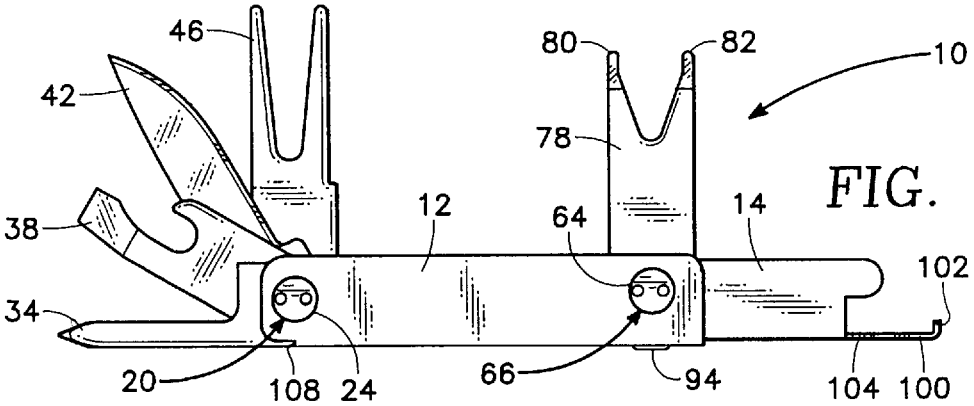
FIG. 1 is a side elevational view of the tool holder of the present invention showing the tool holder in the open position with the different instruments of the tool holder located in an outwardly extending position.

Referring particularly to the drawings, there is shown the tool holder 10 of this invention. The tool holder 10 is constructed primarily of a fixed housing 12 and a movable housing 14. Both the fixed housing 12 and the movable housing 14 will normally be constructed of a metallic material such as stainless steel. The fixed housing 12 is basically in a channel shaped configuration defining an internal compartment 16. The internal compartment 16 is open ended at each end. The movable housing 14 also includes an internal compartment 18. The internal compartment 18 is also open at each end.

At one end of the fixed housing 12 there is mounted a pivot pin assembly 20. The pivot pin assembly 20 comprises an inner pin 22 and an outer pin 24 which are mounted in a facing relationship within a threaded sleeve 26. The inner pin 22 extends through hole 28 formed within the fixed housing 12. The outer pin 24 extends through hole 30 formed within the fixed housing 12. The pins 22 and 24 are threadably secured within a threaded sleeve 26. Mounted on the threaded sleeve 26 in a sequential arrangement is a washer 32, an instrument 34, a washer 36, an instrument 38, a center washer 40, an instrument 42, a washer 44, an instrument 46 and a washer 48. The washer 32 is located between the fixed housing 12 and the instrument 34, the washer 36 is located between instruments 34 and 38, center washer 40 is located between the tool instruments 38 and 42, washer 44 is located between the instruments 42 and 46 and the washer 48 is located between the instrument 46 and the fixed housing 12. The instrument 34 is sharp pointed for the primary purpose to clean out the grooves in a golf club. The instrument 38 comprises an opener for beverage bottles. The instrument 42 comprises a knife. The instrument 46 is bifurcated and designed primarily for the fixing of ball marks on golf greens.

Each of the instruments 34, 38, 42 and 46 have an aft end 50 that are basically identical. Each aft end 50 defines a pair of ledges 52 and 54 which are formed in the connection of the aft end 50 to the main body of each instrument 34, 38, 42 and 46. The function of these ledges 52 and 54 will be explained further on in the specification.

The movable housing 14, although being of the same basic shape as the fixed housing 12, is of a slightly smaller width. This permits the movable housing 14 to fit within the internal compartment 16 of the fixed housing 12 and is capable of sliding movement therein resembling telescoping movement. The movable housing 14 includes a pair of elongated slots 56 and 58. Formed within fixed housing 12, and directly adjacent the end of the housing that is opposite the end where pivot pin assembly 20 is located, there is formed a pair of aligned holes 60 and 62. A pin 64 of a pin assembly 66 is conducted through the hole 60 and is threadably secured to a threaded sleeve 68 which is located across the internal compartment 18 of the movable housing 14. A pin 70 of the pin assembly 76 is conducted through the hole 62 and is also threadably secured to the threaded sleeve 68.

Mounted on the threaded sleeve 68 are washers 72, 74 and 76. Washer 72 abuts against movable housing 14 and washer 74. Between washers 74 and 76 is located an instrument 78. The instrument 78 is also bifurcated defining a pair of spaced apart prongs 80 and 82 which are to be used to engage with a golf cleat (not shown) of a golf shoe (not shown) to effect tightening or loosening of that cleat. The instrument 78 is pivotable relative to the movable housing 14 and the fixed housing 12 from a collapsed position to a usage position. The usage position is shown in FIGS. 1, 5 and 6 with the instrument 78 extending outwardly at approximately a ninety degree angle relative to the aligned fixed housing 12 and movable housing 14. The collapsed position would be when the instrument 78 is located within the confines of either the internal compartment 18 or the internal compartment 16.

Figure 2:
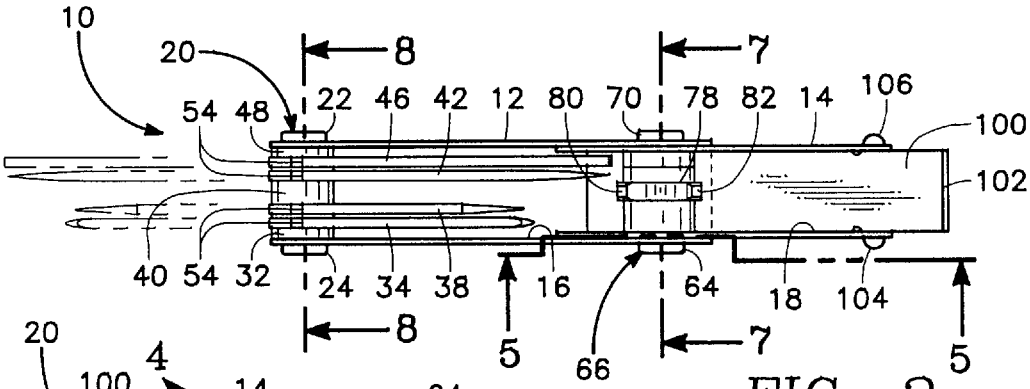
FIG. 2 is a top plan view of the tool holder in FIG. 1 showing some of the instruments in their storage positions.

Although it is desirable that the instrument 78 be easily pivotable about the sleeve 68, it is also desirable that the instrument 78 remain in whatever position it is established so that it will not fall by itself under the action of gravity. In order to achieve that end result, there is included a disc spring 84 mounted within a concavity 86 formed within the washer 72. It is the function of the disc spring 84 to exert a bias against the washer 74. This bias, in conjunction the precise amount of tightening between the pins 60 and 70 relative to the threaded rod 68, will produce the precise amount of tension so that the instrument 78 will achieve the above stated objectives. Also, included within the center washer 40 is a concavity 88, and within that concavity 88 is a disc spring 90. The disc spring 90 is to be used for the same purpose so that the instruments 34, 38, 42 and 46 will function in the same manner during the pivoting motion from their outwardly extended position, shown in phantom lines in FIG. 2, to the stowage position, shown in solid lines in FIG. 2.

The instrument 78 includes an elongated hole 92. The threaded sleeve 68 passes through the elongated hole 92. The aft end of the instrument 78 includes a protrusion 94. The fixed housing 12 includes a hole 96. The movable housing 14 includes a hole 98.

The movable housing 14 has a protruding tongue 100. The outer end of the protruding tongue 100 is formed into a right angled flange 102. Mounted on one of the sidewalls of the protruding tongue 100 is a handle 104, and on the opposite sidewall of the protruding tongue 100 is a handle 106.

Figure 3:
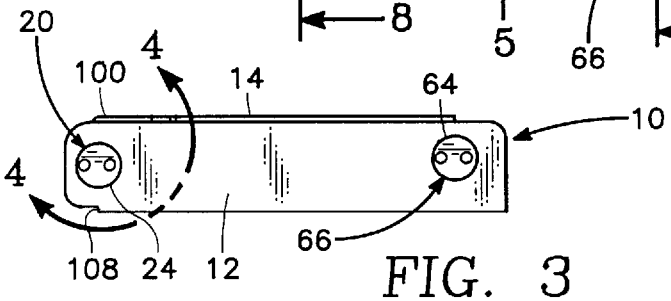
FIG. 3 is a side elevational view similar to FIG. 1 but showing the tool holder in the closed position.
Figure 4:
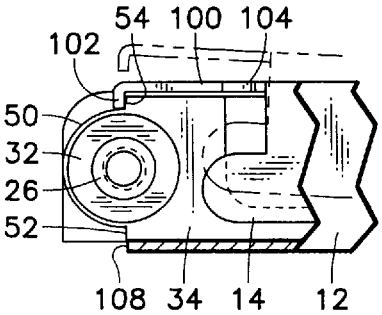
FIG. 4 is a cross-sectional view showing the interlocking relationship between the movable housing and the fixed housing of the tool holder of the present invention.
Figure 8:
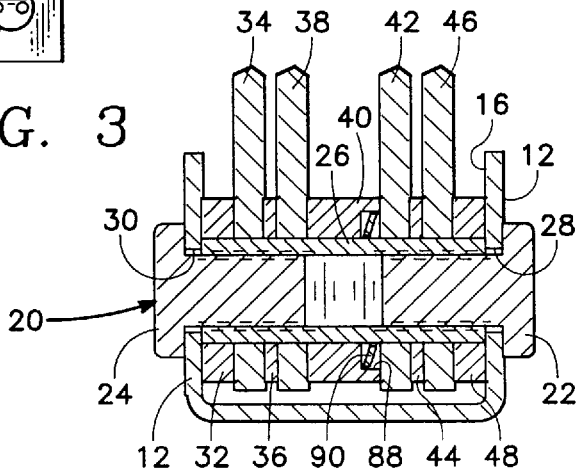
FIG. 8 is a cross-sectional view taken along line 8—8 of FIG. 2.

The use of the tool holder 10 of this invention is as follows. Let it be assumed that the tool holder is in the closed position shown in FIG. 3 which is where the movable housing 14 is in juxtaposition with the fixed housing 12. The user will then grasp the handles 104 and 106 and pivot the movable housing 14 to be in substantial alignment with the fixed housing 12. The user then decides what instrument is to be used. Let it be assumed that the user wishes to use one of the instruments 34, 38, 42 or 46. The user would grasp the fixed housing 12 and thrust outward the fixed housing 12 with a sharp jolt which will cause the tool instruments 34, 38, 42 or 46 to be partially pivoted in an outward direction substantially as shown in FIG. 1. The user will then select the desired instrument of the four and then replace the three instruments back within the internal compartment 16. The user then repositions the movable housing 14 by pivoting of such about the pivot pin assembly 66 until handles 104 and 106 come into contact with the upper side edges of the fixed housing 12. At this time, the flange 102 will abut against the ledge 52 with the ledge 54 abutting against lower edge 108 of the fixed housing 12. The result is the instrument of the instruments 34, 38, 42 and 46 that is located in the protruding position is now locked in position and fixed relative to the fixed housing 12 and the movable housing 14. The instrument is then to be used in a desired manner.

Suppose, instead, the user wished to make use of instrument 78. The instruments 34, 38, 42 and 46 will be left to remain in the internal compartment 16. With the movable housing 14 in the aligned position with the fixed housing 12 as shown in FIGS. 1, 2, 5 and 6 of the drawings, the instrument 78 is grasped and pulled in an outward direction in direction of arrow 112 locating the instrument 78 at its ninety degree angle position relative to the fixed housing 12 and movable housing 14. This position is shown in FIG. 5 of the drawings. The user then moves the movable housing 14 in direction of arrow 114 toward the fixed housing 12 which causes the sleeve 68 to be moved from one end of the elongated slot 56 to the opposite end of the elongated slot 56. This will cause the holes 96 and 98 to be aligned. By pushing of the instrument in the direction of arrow 110, the protrusion 94 will be forced within the aligned holes 96 and 98. The result is the movable housing 14 is now locked to the fixed housing 12. The instrument 78 is also locked in position relative to the movable housing 14. The prongs 80 and 82 can then be located in conjunction with holes formed within shoe cleats (not shown) and torque be used to tighten or loosen these cleats by grasping of the movable housing 14 and the fixed housing 12 using such as a handle.

When it is desired to move the tool holder to the closed position, it is necessary to exert a lifting force on the instrument 78 removing the protrusion 94 from the aligned holes 96 and 98. The movable housing 14 is then moved in a direction away from the fixed housing 12 from the position shown in FIG. 6 to the position shown in FIG. 5. The movable housing 14 is then pivoted relative to the fixed housing 12 which will cause the instrument 78 to be located within the space defined by center washer 40 between instruments 38 and 42. Further pivotal movement of the movable housing 14 relative to the fixed housing 12 will result in the handles 104 and 106 again contacting the upper side edges of the fixed housing 12 and the right angled flange 102 being positioned against the ledges 54. This is again the closed position of the tool holder 10.

What is claimed is:

1. A tool holder comprising:

a fixed housing having an internal compartment;

a movable housing mounted by a first pivot pin on said fixed housing, said movable housing being pivotally movable between a closed position and an open position, said closed position locating said movable housing in juxtaposition with said fixed housing closing said internal compartment to the ambient, said open position locating said movable housing substantially in alignment with said fixed housing and exposing said internal compartment to the ambient;

a first instrument pivotally mounted on said first pivot pin and movable between a collapsed position and an usage position, said first instrument having a front end and a back end, said front end adapted to be used by a human to perform an operation on an exterior structure, said collapsed position locating said first instrument in said internal compartment, said usage position locating said first instrument in an outwardly extending position relative to said internal compartment; and locking means fixing in position said movable housing and said first instrument to said fixed housing when said first instrument is in said outwardly extending position.

2. The tool holder as defined in claim 1 wherein said locking means comprises:

said back end includes a protuberance, a first hole formed within said fixed housing, a second hole formed within said movable housing, upon said first and second holes being aligned said protuberance being movable with in said first and second holes when said first instrument is in said usage position.

3. The tool holder as defined in claim 2 wherein:

said movable housing being telescopingly slidable between an inward position and an outward position relative to said fixed housing, said movable housing must be in said inward position to engage said protuberance with said first hole and said second hole, with said protuberance connecting with said first hole and said second hole sliding movement of said movable housing relative to said fixed housing is prevented.

4. The tool holder as defined in claim 1 wherein:

a second instrument pivotally mounted to said fixed housing, said second instrument being movable between a storage position and an outwardly extending position, when said second instrument is in said outwardly extending position and said movable housing is in said closed position said second instrument being locked in position.

5. The tool holder as defined in claim 4 wherein:

there being a plurality of said second instruments pivotally mounted to said fixed housing.

* * * * *